United States Patent [19]

Wang

[11] Patent Number: 4,462,134

[45] Date of Patent: Jul. 31, 1984

[54] BLACKBOARD ERASER

[76] Inventor: Jeng-Lin Wang, Rm. 37, 11th Fl., No. 25, Ming-Sheng E. Rd., Taipei, Taiwan

[21] Appl. No.: 451,595

[22] Filed: Dec. 20, 1982

[51] Int. Cl.[3] ..... B43L 21/00

[52] U.S. Cl. ..... 15/98; 15/27; 15/97 R; 15/210 R; 15/221; 434/417

[58] Field of Search ..... 15/27, 97 R, 98, 210 R, 15/221, 209 R; 434/417

[56] References Cited

U.S. PATENT DOCUMENTS 1,487,052 3/1924 Enomoto ..... 15/210 R

FOREIGN PATENT DOCUMENTS 2090123 7/1982 United Kingdom ..... 15/210 R

*Primary Examiner*—Edward L. Roberts

[57] ABSTRACT

A blackboard eraser comprising a base, an uppermost cover mounted on the base, two erasing rollers pivotedly mounted within the base, a controller and two scrapers wherein the controller normally engages with the rollers for erasing use and may be depressed to release the rollers for their free rotation to contact the scrapers formed atop the rollers so as to scrape the dust accumulated on roller into a storing chamber spaced between the base and the uppermost cover for final disposal of dust.

5 Claims, 3 Drawing Figures

BLACKBOARD ERASER

Background of the invention

Conventional blackboard eraser is generally formed with velvet or cotton cloth having plurality of corrugations on its surface to rub the chalk dust. However, the recesses on conventional eraser are too shallow and small in area to accumulate much chalk dust. The dust fast accumulated on eraser should be frequently removed which will cause inconvenience for the user. The flying dust caused as clapping the eraser will make air pollutants to affect the personal health and environmental hygiene. Although recently developed eraser is electrically operated to such chalk dust when erasing on blackboard, the electric eraser is expensive in cost, difficult to construct and maintain, heavy to carry, and the connected power lines may obstruct the user's operation. Such inconvenience of eraser operation may influence the teacher's emotion during lecturing. The consumption of electric power may waste energy and money for the user.

The present inventor has found the defects of conventional eraser and invented the present instantly cleaning eraser.

Summary of the Invention

The object of the present invention is to provide a blackboard eraser comprising a base, an uppermost cover, two erasing rollers, a controller and two dust scrapers wherein the controller is normally operated to engage with the erasing rollers for reciprocative movement to remove the chalk dust formed on blackboard and the controller may be depressed to release the rollers for their free rotation so that the dust, when much accumulated on roller perimeters, may be removed by the scrapers formed atop on rollers as scraping the rotating rollers and then transferred into the chamber spaced between the base and the uppermost cover for final disposal.

Detailed Description

Figure 1:
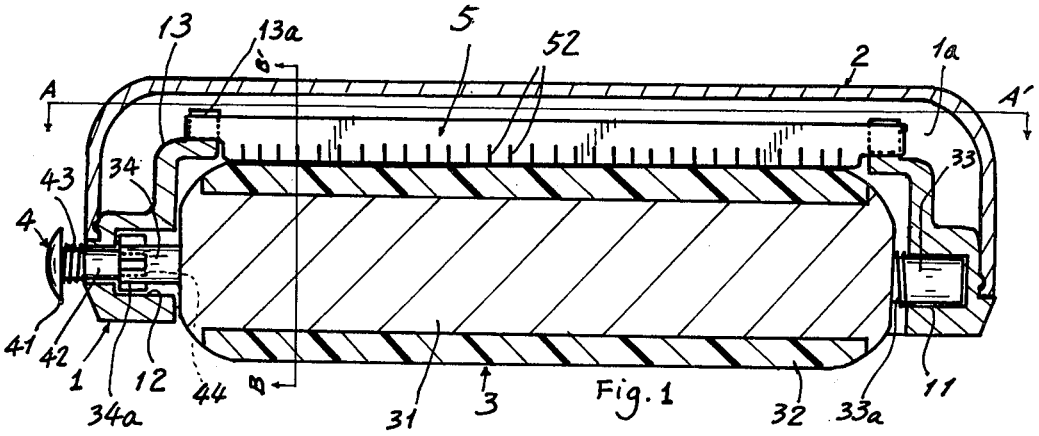
FIG. 1 is a sectional drawing of the present invention.

As shown in the figures, the present invention comprises: a base 1, an uppermost cover 2 mounted on base 1, two erasing rollers 3 each being respectively and rotatably mounted within base 1, a controller 4 formed on base 1 and operatively locking erasing rollers 3 for erasing dust on blackboard or releasing rollers for dust removal, and two dust scrapers 5 which are mounted on the base 1 for contacting the rollers 3 for scraping dust accumulated on rollers 3 into a storing chamber 1*a* spaced between base 1 and cover 2 for final removal of dust.

Base 1 comprises a pair of first sockets 11 for the insertion of a pair of first shafts 33 of rollers 3 and another pair of second sockets 12 formed on the side opposite to first sockets 11 for the insertion of another pair of second shafts 34 of rollers 3. A base canopy 13 is formed atop all sockets 11, 12. Canopy 13 is formed with four brackets 13*a*, every two brackets being respectively disposed on both sides of base 1 for fixing each scraper 5 thereon. Two elongated openings 13*b* are provided in parallel on canopy 13 to respectively extend the upper perimeters of rollers 3 to touch the scrapers 5.

Each erasing roller 3 comprises a central bar 31 and an erasing layer 32 made from soft foam or elastomer which is coated on bar 31. The perimeter of erasing layer 32 is formed with corrugations 32*a* for frictionally scraping chalk dust on blackboard BS. Several fin extensions 34*a* are formed on each second shaft 34 of roller 3. Such extensions 34*a* may be trifurcate or other polygonal forms. A small spring 33*a* may be jacketed onto first shaft 33 for helping stabilization of roller 3 in use.

Figure 2:
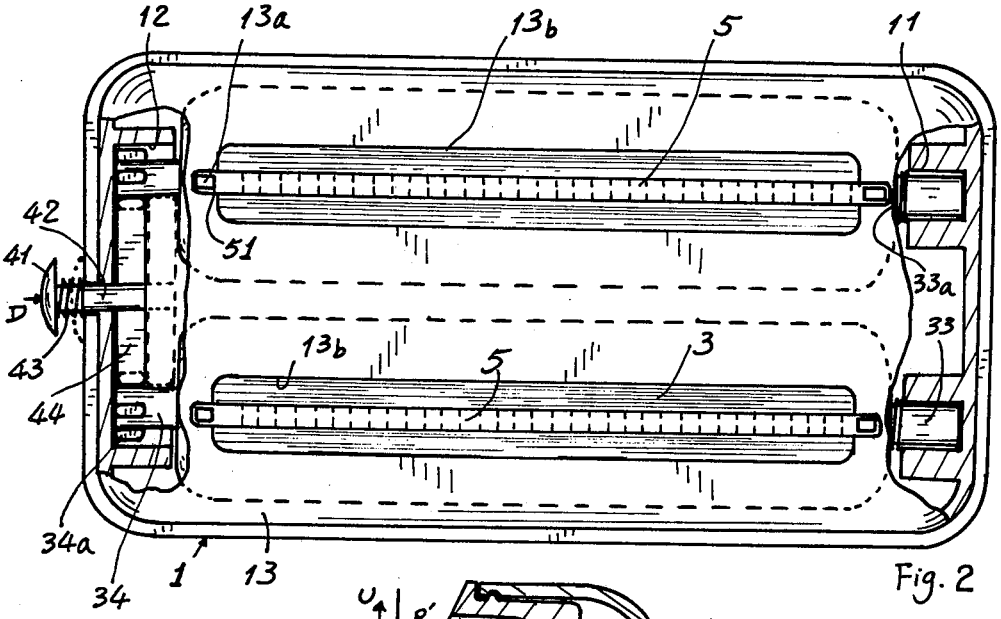
FIG. 2 is a top-view illustration taken from AA' direction of FIG. 1.
Figure 3:
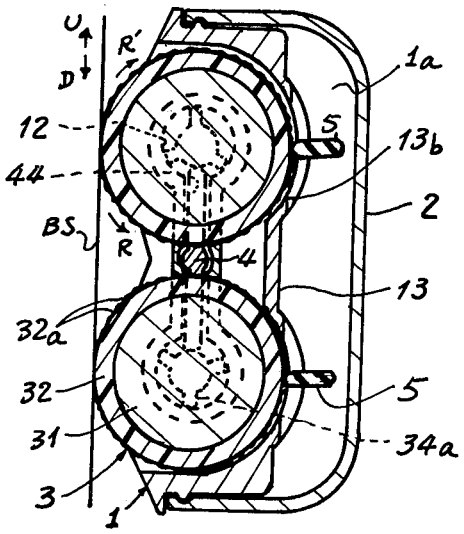
FIG. 3 is a side-view illustration taken from BB' direction of FIG. 1.

Controller 4 comprises a button 41, a stem 42 extended from button, a latch 44 terminated on stem 42 and a restoring spring 43 normally tensioning controller 4 outwards to engage latch 42 within either two fin extensions 34*a* of roller 3 as shown in FIGS. 2 and 3.

Dust scrapers 5 are made from elastomers such as rubber. Both ends 51 of each scraper 5 is fixed on both brackets 13*a* of base canopy 13. Scraper 5 is formed with plurality of short linear cuts 52 on its lower portion for efficiently scraping dust accumulated on roller perimeter.

When using the present invention to erase chalk dust on blackboard BS as shown in FIG. 3, button 41 is normally backed outwards by spring 43 to engage latch 44 with fin extensions 34*a* of each roller 3 so that roller 3 may move reciprocatively in a small radians (RR') when moving the present invention upwards or downwards (UD) and the dust will be scraped onto corrugations 32*a* formed on roller perimeter. After using the present invention in a time interval, the user may depress the button 41 to release latch 44 from fin extensions 34*a* of roller 3 as dotted line shown in FIG. 2 so that the rollers 3 may free rotate the dust-accumulated corrugations 32*a* beyond the lengthly openings 13*b* to touch the scrapers which will scrape the dust on rollers 3 and transfer dust into storing chamber 1*a* for final disposal by opening the uppermost cover 2.

The present invention has the following advantages superior to any conventional eraser:

1. The eraser may be used to erase the blackboard and may scrape, in situ, the dust accumulated thereon into its storing chamber for convenient operation and prevention of air pollution for personal health and environmental hygiene.

2. No electrical or other kinetic power is used and the present invention can be simply and fast operated merely by user's hand so as to save energy and reduce the operation cost.

I claim:

1. A blackboard eraser comprising:

a base;

an uppermost cover mounted on said base and forming a storing chamber for accumulating dust therein, which is spaced between said uppermost cover and said base; two erasing rollers each rotatably mounted within said base;

a controller normally engaging with said rollers during erasing operation to prevent rotation or for releasing said rollers for their free rotation for dust removal; and two dust scrapers respectively fixed on said base, each resiliently contacting the upper perimeter of each roller.

2. An eraser according to claim 1, wherein said rollers have shaft portions at both ends thereof, said base is formed with ends having sockets for rotatably mounting the shaft portions of said rollers, each said roller having the shaft portion having fin extensions on the shaft portion end to engage with a latch of said controller for limiting movement of said rollrs to limited rotational movement, each roller being formed with an erasing layer coated on its surface and corrugations being made along the perimeter of said erasing layer.

3. An eraser according to claim 1, wherein said base is formed with a canopy above all sockets, said canopy being cut with two elongated openings to permit the upper perimeters of said rollers to touch said scrapers.

4. An eraser according to claim 3, wherein said scrapers are each made from rubber elastomer and are fixed on both sides of said openings and extends along said openings to resiliently contact the upper perimeter of said rollers extending through said openings of said canopy, the portion of said scrapers contacting said rollers being formed with plurality of short linear cuts.

5. An eraser according to claim 1, wherein said controller comprises a button, a stem extended from said button, a restoring spring jacketed on said stem and normally tensioning said button outwards from said base, and a latch terminated on said stem for engaging with said fin extensions of said rollers.

* * * * *